US009745834B2

(12) United States Patent
Di Pietro

(10) Patent No.: US 9,745,834 B2
(45) Date of Patent: Aug. 29, 2017

(54) COMPLETION TOOL, STRING COMPLETION SYSTEM, AND METHOD OF COMPLETING A WELL

(71) Applicant: Mario Di Pietro, Pescara (IT)

(72) Inventor: Mario Di Pietro, Pescara (IT)

(73) Assignee: BAKER HUGHES INCORPORATED, Houston, TX (US)

( * ) Notice: Subject to any disclaimer, the term of this patent is extended or adjusted under 35 U.S.C. 154(b) by 322 days.

(21) Appl. No.: 14/332,955

(22) Filed: Jul. 16, 2014

(65) Prior Publication Data

US 2016/0017697 A1 Jan. 21, 2016

(51) Int. Cl.

| | |
|---|---|
| ***E21B 23/06*** | (2006.01) |
| ***E21B 33/124*** | (2006.01) |
| ***E21B 33/128*** | (2006.01) |
| ***E21B 34/14*** | (2006.01) |
| ***E21B 43/00*** | (2006.01) |
| ***E21B 43/08*** | (2006.01) |
| ***E21B 43/14*** | (2006.01) |
| ***E21B 43/26*** | (2006.01) |
| *E21B 34/00* | (2006.01) |

(52) U.S. Cl.

CPC ..... *E21B 43/08* (2013.01); *E21B 2034/007* (2013.01)

(58) Field of Classification Search

CPC ..... E21B 33/1208; E21B 2034/007; E21B 33/1285; E21B 34/14; E21B 43/08; E21B 43/12

See application file for complete search history.

(56) References Cited

U.S. PATENT DOCUMENTS 4,372,384 A * 2/1983 Kinney ..... E21B 43/04 166/278
6,446,729 B1 * 9/2002 Bixenman ..... E21B 33/124 166/205
6,619,397 B2 * 9/2003 Coon ..... E21B 34/12 166/236

(Continued)

FOREIGN PATENT DOCUMENTS

WO WO 2008051250 A2 * 5/2008 ..... E21B 19/22

OTHER PUBLICATIONS

Augustine, et al. "Modeling the Dynamic Pressure Response of Ball-Actuated Stimulation Sleeves";Society of Petroleum Engineers; (2011); 11 pages.

(Continued)

*Primary Examiner* — Daniel P Stephenson
(74) *Attorney, Agent, or Firm* — Cantor Colburn LLP

(57) ABSTRACT

A completion system includes, a tool string having, a plurality of packers configured to isolate a plurality of zones along a borehole that the tool string is positioned within. A plurality of ports along the tool string are configured to be selectively opened and a plurality of screens in operable communication with the plurality of ports are configured to filter fluid flowing between the zones and an inside of the tool string through the plurality of ports. The tool string is also configured to be run into the borehole, the plurality of packers set, the plurality of ports selectively opened, and fluid to flow between the plurality of zones and an inside of the tool string without intervention.

24 Claims, 2 Drawing Sheets

(56) References Cited

U.S. PATENT DOCUMENTS

| | | | | |
|---|---|---|---|---|
| 7,681,651 | B2 * | 3/2010 | Loughlin | E21B 33/1285 166/106 |
| 8,746,337 | B2 * | 6/2014 | Grigsby | E21B 43/04 166/278 |
| 8,794,323 | B2 * | 8/2014 | Luce | E21B 43/04 166/278 |
| 9,062,530 | B2 * | 6/2015 | Patel | E21B 43/04 |
| 9,163,488 | B2 * | 10/2015 | Tips | E21B 43/08 |
| 2002/0079099 | A1 * | 6/2002 | Hurst | E21B 43/045 166/278 |
| 2009/0095471 | A1 * | 4/2009 | Guignard | E21B 34/14 166/278 |
| 2012/0199346 | A1 * | 8/2012 | Patel | E21B 43/08 166/278 |
| 2013/0062066 | A1 * | 3/2013 | Broussard | E21B 34/06 166/305.1 |
| 2015/0075780 | A1 * | 3/2015 | Richards | E21B 17/04 166/250.1 |
| 2016/0017697 | A1 * | 1/2016 | Di Pietro | E21B 43/08 166/308.1 |

OTHER PUBLICATIONS

Yuan, et al.; "Unlimited Multistage Frac Completion System: A Revolutionary Ball-Activated System with Single Size Balls"; Society of Petroleum Engineers; (2013); 9 pages.

Notification of Transmittal of the Written Opinion of the International Searching Authority, or the Declaration; PCT/US2015/035533; dated Sep. 1, 2015; 9 pages.

Notification of Transmittal of the International Search Report of the International Searching Authority, or the Declaration; PCT/US2015/035533; dated Sep. 1, 2015; 3 pages.

* cited by examiner

COMPLETION TOOL, STRING COMPLETION SYSTEM, AND METHOD OF COMPLETING A WELL

BACKGROUND

Completing a well is typically a time consuming project that requires many steps. Some of these steps include setting packers, shifting valves, treating zones of a formation, packing gravel, and cementing annular spaces, for example. Most of these steps involve running one or more tools into the borehole. These interventions consume resources and extend the time before production can begin. As such, those that work in the industry are always interested in systems and methods that improve efficiency of their operations.

BRIEF DESCRIPTION

Disclosed herein is a completion system. The system includes, a tool string having, a plurality of packers configured to isolate a plurality of zones along a borehole that the tool string is positioned within. A plurality of ports along the tool string are configured to be selectively opened and a plurality of screens in operable communication with the plurality of ports are configured to filter fluid flowing between the zones and an inside of the tool string through the plurality of ports. The tool string is also configured to be run into the borehole, the plurality of packers set, the plurality of ports selectively opened, and fluid to flow between the plurality of zones and an inside of the tool string without intervention.

Further disclosed herein is a method of completing a well. The method includes, running a tool string into a borehole, isolating a plurality of zones along the borehole with the tool string, selectively opening ports in the tool string, establishing fluidic communication between an inside of the tool string and the plurality of zones through the selectively opened ports, and flowing fluid between the plurality of zones and an inside of the tool string through the opened ports all without intervention.

Further disclosed herein is a completion tool string. The completion tool string includes, a tubular having: a plurality of ports therethrough, a sleeve in operable communication with each of the plurality of ports configured to at least either occlude or allow fluid flow through the port the sleeve is in operable communication depending upon a position of the sleeve, a screen in operable communication with each of the plurality of ports configured to filter fluid flowing through the port the screen is in operable communication with, and a plurality of packers in operable communication with the tubular configured to sealingly separate annular spaces defined between the tubular and a borehole the completion string is positionable within into separate zones.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
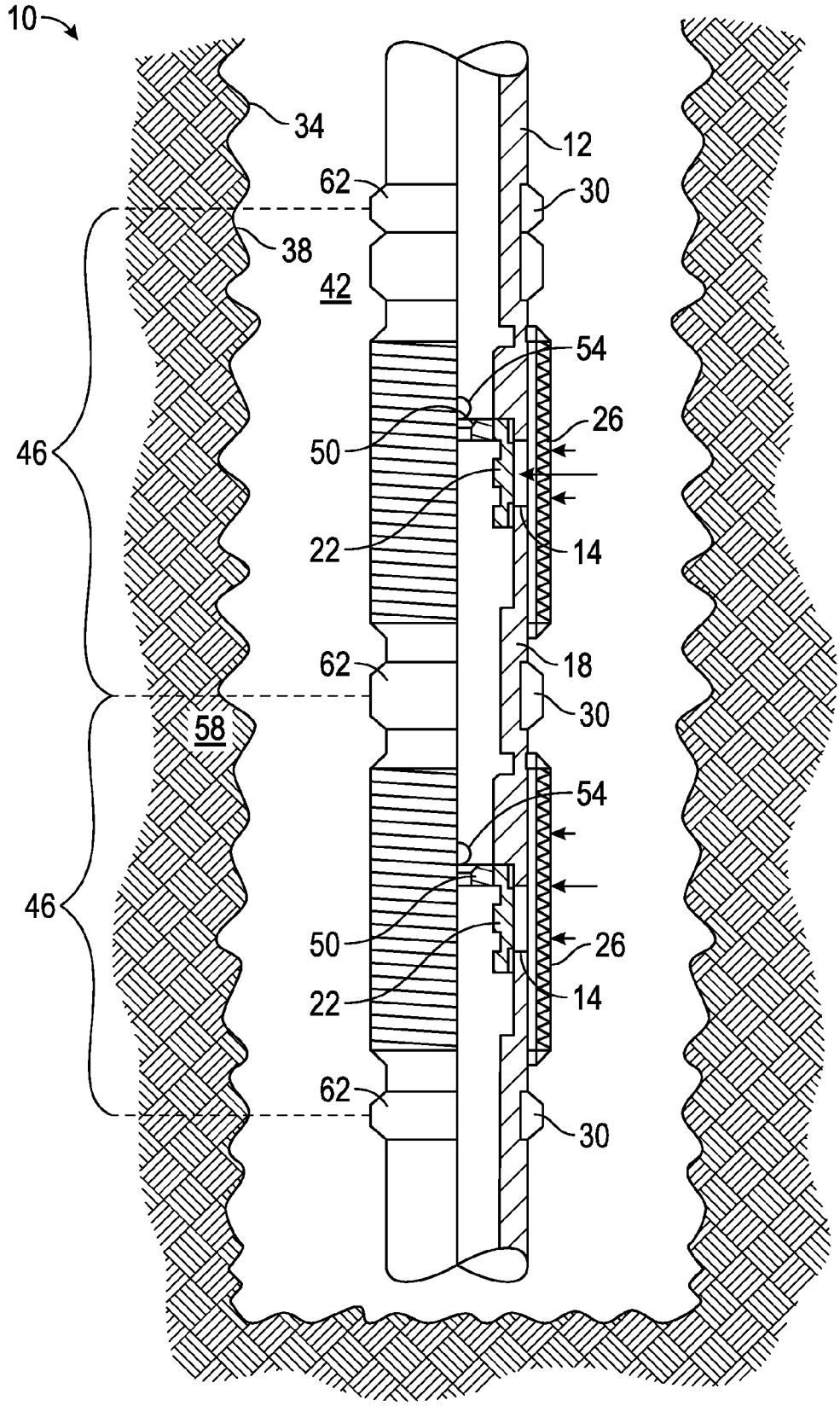
FIG. 1 depicts a quarter cross sectional view or a completion tool string disclosed herein.

Referring to FIG. 1, an embodiment of a completion tool string disclosed herein is illustrated at 10. The completion tool string 10 includes a tubular 12 having a plurality of ports 14 through walls 18 thereof. Sleeves 22 are in operable communication with the ports 14 to occlude or allow flow through the ports 14 that each of the sleeves 22 is in communication with depending upon a position of the sleeve 22. Screens 26 are also in operable communication with the ports 14 and are configured to filter fluid flowing through the ports 14 regardless of direction of fluid flow through the ports 14. The screens 26 are initially positioned relative to the ports 14 in one embodiment to filter fluid that flows through the ports 14 without requiring movement of or changes to the screens 26. A plurality of packers 30 are in operable communication with the tubular 12 and configured to sealingly engage the tubular 12 to walls 34 of a borehole 38 within which the tubular 12 is positionable. As such, the packers 30 separate an annular space 42 defined between the tubular 12 and the walls 34 into zones 46 that are longitudinally separated from one another.

In one embodiment the completion tool string 10 includes a plug seat 50 connected to each of the sleeves 22. As such, plugs 54, shown as balls in the illustrations, can be run through the tubular 12 and selectively or sequentially sealed to each of the seats 50. Once one of the plugs 54 is seated pressure within the tubular 12 can be built against the plug 54 to urge the sleeve 22 to move. In this embodiment the sleeve 22 moves from a position that initially occludes the ports 14 associated therewith to a position that allows flow through the ports 14 associated therewith. The sequencing of seating the plugs 54 can be achieved by positioning the seats 50 pluggable by smaller of the plugs 54 further down the tubular 12 than the larger seats 50. As such, the seats 50 can be sequentially plugged by plugs 54 with ever increasing sizes.

Once one of the ports 14 is open a formation 58 in one of the zones 46 in fluidic communication with the open port 14 can be treated or produced from. The completion tool string 10 allows all of the foregoing to be carried out with a single run of the tool string 10 into the borehole 38 with no intervention therewithin. Treatments of the formation 58 can include one or more of several possible treatments such as, acid treating or fracturing, for example. Regardless of whether the formation 58 is being treated or fluid is being produced therefrom fluid flowing through the open ports 14 will also flow through the screen 26 in association with the open ports 14 filtering the fluid in the process.

Figure 2:
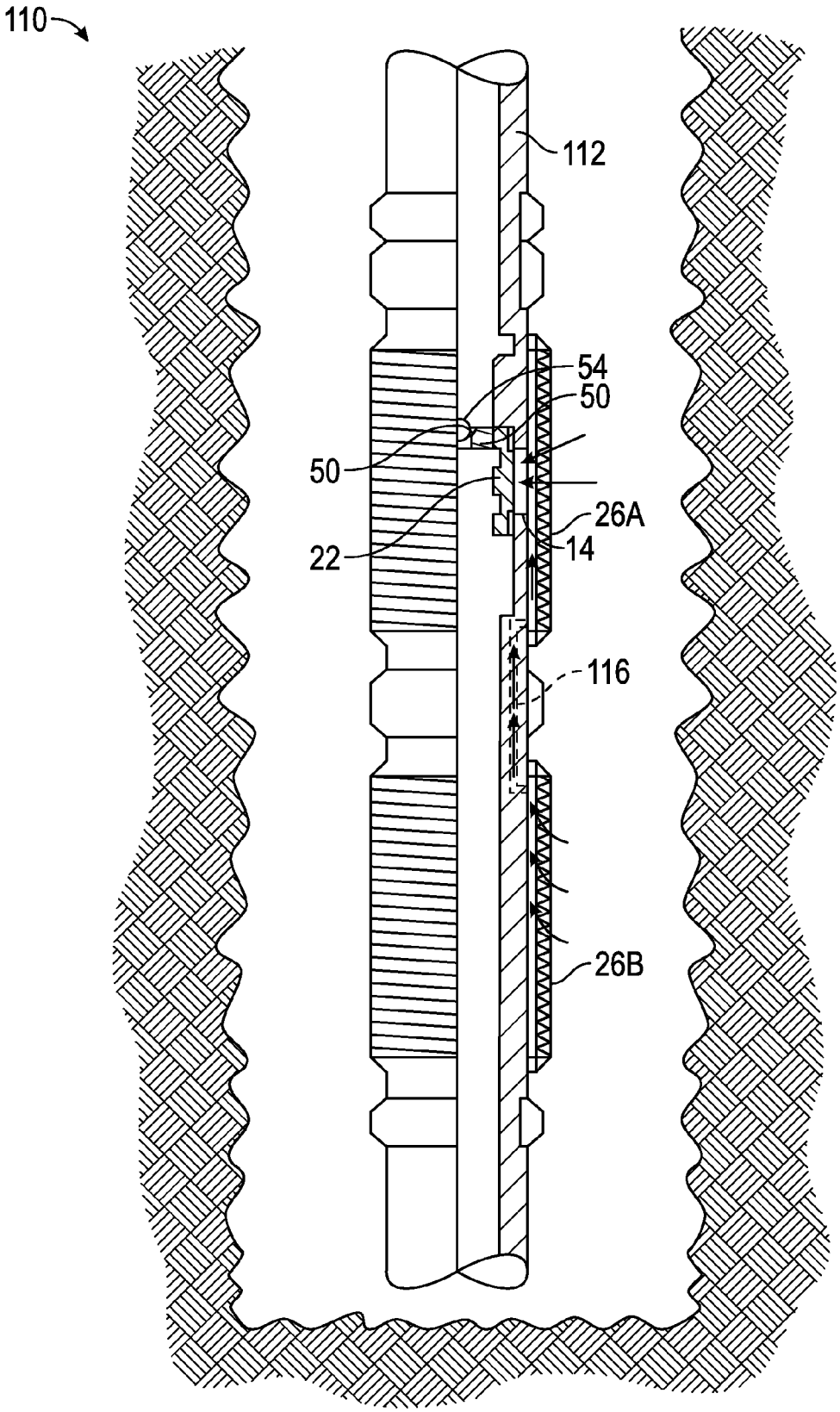
FIG. 2 depicts a quarter cross sectional view of an alternate completion tool string disclosed herein.

The setting of the packers 30, to isolate the zones 46 from one another, can be done in a few different ways. For example, the packers 30 can employ swellable members 62 that swell in response to exposure to a target environment. One target environment can be fluids anticipated to be present in the borehole 38 the tubular 12 will be positioned within. In applications where in the borehole 38 is in an open hole of the earth formation 58 such fluid can be oil, water, brine, acid and gas, or combinations of these, for example. As such, the packers 30 would essentially be self-setting in that no additional steps need to be taken beyond positioning the tool string 10 into the borehole 38. Another way to set the packers 30 could be via control lines (not shown) that supply pressurized fluid actuators disposed at each of the packers 30, for example. Alternately the full tool string 10 can be pressured up (i.e. without requiring one of the plugs 54), to set the packers 30. Still other embodiments could use hydrostatic pressure within the borehole 38 to set the packers 30. Referring to FIG. 2, an alternate embodiment of a completion tool string disclosed herein is illustrated at 110.

The tool string 110 has similarities to the tool string 10 and as such primarily the differences between the two will be discussed hereunder. Like the tool string 10 the tool string 110 includes the ports 14 through a tubular 112 that are coverable by the movable sleeves 22. And the sleeves 22 are movable in response to pressure built against the plugs 54 sealed on the seats 50. The tool string 110 differs in that not all of the screens 26A and 26B have the ports 14 positioned longitudinally adjacent thereof. Instead, a passageway 116 runs through the tubular 112 thereby fluidically connecting a longitudinally displaced one of the screens 26B to the ports 14. Such an arrangement allows for fluid flow between more than one of the screens 26A, 26B for each one of the ports 14. This allows for a reduction in the number of the sleeves 22 and the ports 14 that are required in comparison to the number of the screens 26A, 26B that are employed.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A completion system, comprising:

a tool string having;

a tubular;

a plurality of packers arranged with the tubular and configured to isolate a plurality of zones along a borehole the tool string is positioned within;

a plurality of ports along the tubular configured to be selectively opened;

one or more sleeves disposed on an interior surface of the tubular and radially inward of one or more of the plurality of ports, a position of the one or more sleeves determining whether a port associated with a sleeve is open or closed, the one or more sleeves each including a plug seat configured to receive a plug thereon, the sleeves movable from closed to open in response to pressure within the tool string applied against the plug selectively positioned at the one or more sleeves; and a plurality of screens disposed on an exterior surface of the tubular and radially outward of one or more of the plurality of ports, the plurality of screens in operable communication with the plurality of ports configured to filter fluid flowing between the zones and an inside of the tool string through the plurality of ports, the tool string being configured to be run into the borehole;

the plurality of packers being set, the plurality of ports selectively opened, and fluid to flow between the plurality of zones and an inside of the tool string all without intervention by another string.

2. The completion system of claim 1, wherein the plurality of packers are self-setting.

3. The completion system of claim 1, wherein the plurality of packers set by swelling a member into engagement with walls of the borehole.

4. The completion system of claim 1, wherein screens filter fluid flowable through the plurality of ports.

5. The completion system of claim 1, wherein flow through more than one of the plurality of screens flows through ports opened by one of the plurality of sleeves.

6. The completion system of claim 1, wherein each of the plurality of screens is in operable communication with one of the plurality of sleeves.

7. The completion system of claim 1, wherein the tool string is configured to complete within an open borehole.

8. The completion system of claim 1, wherein the completion system is configured to selectively treat formations in the zones.

9. The completion system of claim 1, wherein the formation treatment includes acid treating and fracturing.

10. The completion system of claim 1, wherein the plurality of packers are set by hydrostatic pressure.

11. The completion system of claim 1, wherein the plurality of screens are initially positioned to filter fluid that flows through the plurality of ports.

12. The completion system of claim 1, wherein the one or move sleeves are sequenced within the tool string such that the plug seat in each sleeve is receptive of plugs having increasingly larger sizes in a downhole to uphole direction of the completion system.

13. The completion system of claim 1, wherein at least a portion of a respective port, sleeve, and screen, amongst the plurality of ports, the one or more sleeves, and the plurality of screens, are longitudinally aligned in a closed condition of the respective sleeve.

14. The completion system of claim 1, wherein the plurality of ports, the one or more sleeves, and the plurality of screens, includes first ports, first sleeves, and first screens, and further comprising one or more second screens not longitudinally aligned with any port in the tubular, and a passageway fluidically connecting the one or more second screens to one or more of the first ports.

15. The completion system of claim 14, wherein the passageway extends longitudinally through a wall of the tubular.

16. A method of completing a well without intervention by another string, the method comprising:

isolating a plurality of zones along a borehole with a tool string, the tool string having a tubular;

selectively opening ports in the tubular of the tool string by pressuring up against plugs seated against seats to selectively open the ports, the seats provided on sleeves disposed on an interior of the tubular and radially inward of the ports, the sleeves movable from closed to open in response to the pressuring up;

establishing fluidic communication between an inside of the tool string and the plurality of zones through the selectively opened ports;

flowing fluid between the plurality of zones and an inside of the tool string through the opened ports all without intervention by another string; and, passing fluid flowing through the opened ports through screens disposed on an exterior of the tubular and radially outward of the ports.

17. The method of claim 16, wherein passing fluid flowing through the opened ports through screens includes filtering fluid flowing from one or more of the plurality of zones into the inside of the tool string.

18. The method of claim 16, further comprising treating a formation in the plurality of zones through the selectively opened ports.

19. The method of claim 16, further comprising acid treating a formation in the plurality of zones through the selectively opened ports.

20. The method of claim 16, further comprising fracturing the formation in the plurality of zones through the selectively opened ports.

21. The method of claim 16, further comprising setting packers to isolate the plurality of zones.

22. The method of claim 16, further comprising pressuring up the full tool string to set the packers.

23. The method of claim 16, further comprising completing the well in an open borehole.

24. The method of claim 16, further comprising producing through the selectively opened ports.

* * * * *